US009217426B2

(12) United States Patent
Wackerle et al.

(10) Patent No.: US 9,217,426 B2
(45) Date of Patent: Dec. 22, 2015

(54) PUMP, PUMP ARRANGEMENT AND PUMP MODULE

(75) Inventors: Martin Wackerle, Munich (DE); Juergen Kruckow, Munich (DE); Martin Richter, Munich (DE); Klaus Heinrich, Munich (DE)

(73) Assignee: Fraunhofer-Gesellschaft zur Foerderung der angewandten Forschung e.v., Munich (DE)

( * ) Notice: Subject to any disclaimer, the term of this patent is extended or adjusted under 35 U.S.C. 154(b) by 922 days.

(21) Appl. No.: 12/739,031

(22) PCT Filed: Oct. 21, 2008

(86) PCT No.: PCT/EP2008/008895

§ 371 (c)(1),
(2), (4) Date: Jun. 28, 2010

(87) PCT Pub. No.: WO2009/053027

PCT Pub. Date: Apr. 30, 2009

(65) Prior Publication Data

US 2011/0280755 A1 Nov. 17, 2011

(30) Foreign Application Priority Data

Oct. 22, 2007 (DE) ..... 10 2007 050 407

(51) Int. Cl.
*F04B 43/06* (2006.01)
*F04B 23/06* (2006.01)
(Continued)

(52) U.S. Cl.
CPC ..... *F04B 43/06* (2013.01); *F04B 23/06* (2013.01); *F04B 43/04* (2013.01); *F04B 43/046* (2013.01); *F04B 53/1047* (2013.01)

(58) Field of Classification Search
CPC .... F04B 43/025; F04B 43/028; F04B 45/041; F04B 45/043; F04B 43/06; F04B 43/046; F04B 53/1047; F04B 23/06
USPC ..... 417/413.1, 413.2, 413.3, 479, 480
See application file for complete search history.

(56) References Cited

U.S. PATENT DOCUMENTS 4,830,577 A * 5/1989 Moffatt et al. ..... 417/45
5,338,164 A * 8/1994 Sutton et al. ..... 417/413.2
(Continued)

FOREIGN PATENT DOCUMENTS

DE 19719862 A1 * 11/1998
EP 0 546 427 A1 6/1993
(Continued)

OTHER PUBLICATIONS

Translation of DE 19719862 A1, Nov. 1998, Kluge S et al.*
(Continued)

*Primary Examiner* — Justin Jonaitis
*Assistant Examiner* — Charles W Nichols

(57) ABSTRACT

A pump has an inlet opening, an outlet opening, a pump diaphragm comprising an opening, provided with a passive check valve, through the pump diaphragm, and an actuator configured to move the pump diaphragm between a first position and a second position. The passive check valve is configured such that a movement from the first position in the direction toward the second position has a closing effect, and that a movement from the second position in the direction toward the first position has an opening effect, so that a pumping cycle wherein the pump diaphragm is moved from the first to the second positions, and back, causes a net flow from the inlet opening to the outlet opening.

11 Claims, 3 Drawing Sheets

(51) Int. Cl.
*F04B 43/04* (2006.01)
*F04B 53/10* (2006.01)

(56) References Cited

U.S. PATENT DOCUMENTS

| | | | | |
|---|---|---|---|---|
| 6,042,345 | A * | 3/2000 | Bishop et al. | 417/322 |
| 6,142,444 | A | 11/2000 | Kluge | |
| 6,179,586 | B1 * | 1/2001 | Herb et al. | 417/480 |
| 6,237,619 | B1 | 5/2001 | Maillefer et al. | |
| 7,322,803 | B2 * | 1/2008 | Vogeley | 417/413.2 |
| 2004/0244405 | A1 * | 12/2004 | Kim et al. | 62/498 |
| 2006/0232167 | A1 * | 10/2006 | Jordan | 310/324 |

FOREIGN PATENT DOCUMENTS

| | | | |
|---|---|---|---|
| EP | 1 754 890 | A2 | 2/2007 |
| GB | 2 248 891 | A | 4/1992 |
| JP | 03-103680 | A | 4/1991 |
| WO | 2006/111775 | A1 | 10/2006 |

OTHER PUBLICATIONS

Official Communication issued in International Patent Application No. PCT/EP2008/008895, mailed on Aug. 27, 2009.

* cited by examiner

PUMP, PUMP ARRANGEMENT AND PUMP MODULE

Embodiments of the present invention relate to a pump, a pump arrangement and a pump module, and in particular to a pump, a pump arrangement and a pump module that operate using a pump diaphragm and are suitable for micro design.

BACKGROUND

Known compressors for pressure ranges above 10 bar are typically 1- or 2-stage piston cylinder systems comprising a power-efficient electric motor and a design volume that is too large for micro systems.

Minimal compressors having a design volume of less than 1 $dm^3$ are mostly diaphragm pumps with an electric drive. For such minimal compressors, maximum pressure ranges of up to 2 bar are indicated.

By contrast, there are piezoelectric micro diaphragm pumps comprising passive check valves having an installation space of only a few $cm^3$. An exemplary micro diaphragm pump is known from DE 19719862 A1. Said micro diaphragm pump comprises a pump diaphragm that may be moved to first and second positions by a driving means. A pump body is connected to the pump diaphragm so as to define a pump chamber between them. An inlet opening and an outlet opening are provided with passive check valves, respectively.

However, known micro diaphragm pumps only achieve delivery rates of 0.02 l/min for water and 0.05 l/min with air, and the achievable pressures of micro diaphragm pumps are relatively small while having a maximum counterpressure (with compressible gas as the volume to be delivered) of about 400 hPa.

SUMMARY

According to an embodiment, a pump may have: an inlet opening; an outlet opening; a pump diaphragm including an opening, provided with a passive check valve, through the pump diaphragm; an actuator configured to move the pump diaphragm between a first position and a second position, wherein the passive check valve is configured such that a movement from the first position in the direction toward the second position has a closing effect, and that a movement from the second position in the direction toward the first position has an opening effect, so that a pumping cycle wherein the pump diaphragm is moved from the first to the second positions, and back, causes a net flow from the inlet opening to the outlet opening; a further pump diaphragm including an opening, provided with a further check valve, through the further pump diaphragm; a further actuator configured to move the further pump diaphragm between a third position and a fourth position; and a spacer arranged between the pump diaphragm and the further pump diaphragm which, along with the pump diaphragms, defines a pump chamber, wherein the outlet opening is formed by the opening within the pump diaphragm and is provided with the passive check valve, and wherein the inlet opening is formed by the opening within the further pump diaphragm and is provided with the further passive check valve, wherein the actuator and the further actuator are configured to move the pump diaphragm and the further pump diaphragm such that the volume of the pump chamber is increased during a suction phase, and that the volume of the pump chamber is reduced during a pumping phase, wherein the check valve is configured such that a movement of the pump diaphragms during the suction phase has a closing effect, and that a movement of the pump diaphragms during the pumping phase has an opening effect, and wherein the further check valve is configured such that a movement of the pump diaphragms during the suction phase has an opening effect, and that a movement of the pump diaphragms during the pumping phase has a closing effect.

According to another embodiment, a pump arrangement may have: a plurality of pumps fluidically connected in series, which may have: an inlet opening; an outlet opening; a pump diaphragm including an opening, provided with a passive check valve, through the pump diaphragm; an actuator configured to move the pump diaphragm between a first position and a second position, wherein the passive check valve is configured such that a movement from the first position in the direction toward the second position has a closing effect, and that a movement from the second position in the direction toward the first position has an opening effect, so that a pumping cycle wherein the pump diaphragm is moved from the first to the second positions, and back, causes a net flow from the inlet opening to the outlet opening; a further pump diaphragm including an opening, provided with a further check valve, through the further pump diaphragm; a further actuator configured to move the further pump diaphragm between a third position and a fourth position; and a spacer arranged between the pump diaphragm and the further pump diaphragm which, along with the pump diaphragms, defines a pump chamber, wherein the outlet opening is formed by the opening within the pump diaphragm and is provided with the passive check valve, and wherein the inlet opening is formed by the opening within the further pump diaphragm and is provided with the further passive check valve, wherein the actuator and the further actuator are configured to move the pump diaphragm and the further pump diaphragm such that the volume of the pump chamber is increased during a suction phase, and that the volume of the pump chamber is reduced during a pumping phase, wherein the check valve is configured such that a movement of the pump diaphragms during the suction phase has a closing effect, and that a movement of the pump diaphragms during the pumping phase has an opening effect, and wherein the further check valve is configured such that a movement of the pump diaphragms during the suction phase has an opening effect, and that a movement of the pump diaphragms during the pumping phase has a closing effect.

Embodiments of the present invention are based on the finding that, by using a pump diaphragm that has a through-opening arranged through it that is provided with a passive check valve, pumps of a small installation design may be implemented that have high delivery rates both at high and at low pressures. Embodiments of the present invention may be directed to micro pumps or micro diaphragm pumps, which in this context is to be understood to mean diaphragm pumps whose stroke volumes are within or below the microliter range. In embodiments of inventive pumps, the stroke volume may be within a range from 200 nl to 200 μl. Embodiments of the invention provide micro pumps whose delivery rates may amount to several liters per minute both at high pressures and at low pressures that may be provided by the pump.

In embodiments of the present invention, the inlet opening and the outlet opening are formed within a pump chamber, the pump diaphragm being arranged within the pump chamber and dividing same into an inlet-side area and an outlet-side area, the passive check valve being arranged between the inlet-side area and the outlet-side area, and the volume of the outlet-side area of the pump chamber being larger in the first position than in the second position.

Embodiments of the present invention comprise two pump diaphragms having through-openings—provided with check valves—and respective actuation means for same. The pump diaphragms may have a spacer provided between them which along with the pump diaphragms defines a pump chamber. The outlet opening may be formed by means of the opening in one of the pump diaphragms, whereas the inlet opening may be formed by means of the openings of the other pump diaphragms. The actuation means may be configured to move the pump diaphragms such that the volume of the pump chamber is increased during a suction phase, and such that the volume of the pump chamber is reduced during a pumping phase. In the suction phase, the movement of the pump diaphragms may have the effect of closing one of the check valves and of opening the other, whereas during the pumping phase the movement of the pump diaphragms may have the effect of opening one of the check valves and of closing the other one of the check valves.

Embodiments of the present invention enable implementing micro pumps having high delivery rates at different pressures. Embodiments of the invention may enable implementation of micro pumps with a pressure of 16 to 25 bar delivered by them ($16\times10^3$ to $25\times10^3$ hPa) at a delivery of at least 0.5 liters per minute. Such micro pumps may enable, for example, realization of an oil-free micro compressor, for example for being employed in a Bernoullie/Joule-Thompson cooler.

Other embodiments of the invention may enable micro pumps and/or micro compressors comprising a large rate of delivery of one to several liters per minute at a moderate pressure of 50 hPa to 400 hPa.

In embodiments of the invention, the pump may be a piezoelectric micro diaphragm pump wherein the actuating means is a piezoceramic formed on the pump diaphragm. For example, the micro diaphragm may have a circular circumference, it being possible for the piezoceramic to be annularly arranged around a through-opening that is formed in the center and is provided with a passive check valve. The pressure that may be achieved with piezoelectric micro diaphragm pumps depends on the compression ratio, the valve tightness, and the pressure ratio between the top and bottom sides of the pump diaphragm.

Embodiments of the invention enable achieving high pressures with the aid of piezoelectric micro diaphragm pumps without requiring a series connection of several pumps with separate fluid connections. A series connection of several pumps is possible, in principle, when a pressure compensation is ensured, for the pump diaphragm, between the pump inlet and the top surface of the diaphragm, i.e. the pump outlet. In this manner, the maximally possible pressure of the overall system may be determined by the sum of the maximum pressures of the individual pump modules. However, a series connection of micro pumps may be disadvantageous since, firstly, it takes a lot of effort to guide the fluid between the pumps by means of hose connectors or the like. Secondly, such a series connection is also faced with technological limits, since when a relatively high pressure is achieved, the pump diaphragm on the driving side is faced with the ambient pressure, i.e. is exposed to it, as a result of which the actuator unit may be oversized.

Other elements, features, steps, characteristics and advantages of the present invention will become more apparent from the following detailed description of the preferred embodiments with reference to the attached drawings.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
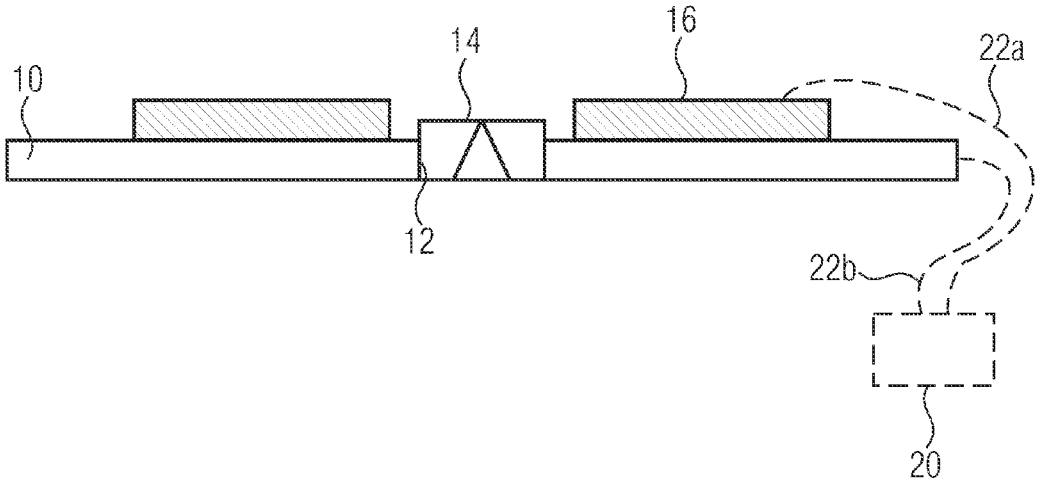
FIG. 1 shows a schematic cross-sectional view of an embodiment of an inventive pump module.

Before addressing the individual figures, it shall be noted that in said figures elements that are identical or have identical actions are designated by the same reference numerals in each case, multiple descriptions of said elements being dispensed with.

An embodiment of an inventive pump module is shown in FIG. 1. The pump module comprises a pump diaphragm 10, a through-opening 12 provided with a passive check valve 14, and a piezoceramic 16 arranged on the pump diaphragm 10. As viewed from the top, the pump diaphragm 10 may have a circular circumference, for example, it being possible for the through-opening 12 comprising the passive check valve 14 to be centrally arranged. The piezoceramic 16 may then annularly surround the through-opening 12.

Schematically, FIG. 1 depicts, in dashed lines, a control means 20 that may be configured to apply a voltage difference to the piezoceramic 16 via corresponding electric connections 22*a* and 22*b* so as to effect actuation of the pump diaphragm. For example, the control means 20 may comprise a controlled voltage source. The control means 20 may be configured to apply a periodic voltage to the piezoceramic, for example a pulsed square-wave voltage having a suitable frequency and a suitable duty cycle (of, e.g., 1:1).

In embodiments of the invention, the pump diaphragm may be a metallic pump diaphragm that may consist of stainless spring steel, for example. The control means 20 may be configured to apply an electric voltage between the metallic pump diaphragm 10 and an electrode arranged on the top surface of the piezoceramic 16. Alternatively, the pump diaphragm 10 may consist of a non-conducting material, such as silicon, in which case corresponding conductive structures may be provided for applying the voltage to the piezoceramic 16.

The passive check valve 14 may be integrated from silicon, for example, it being possible for a check valve chip comprising a corresponding passive check valve 14 to be arranged within the through-opening 12. In alternative embodiments, micro valves made of other suitable materials, such as plastic or metal, may also be considered.

Figure 3:
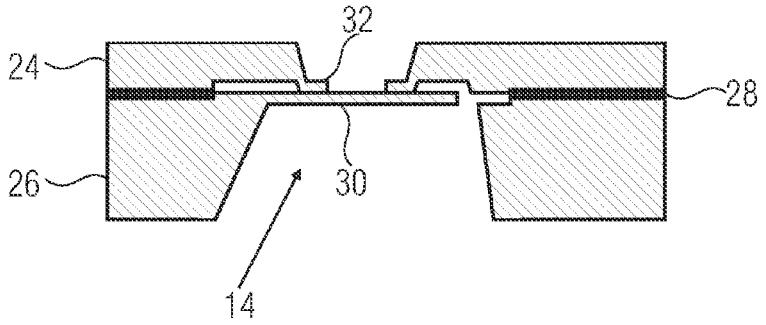
FIG. 3 shows a schematic cross-sectional view of a check valve chip.

An exemplary implementation of a check valve chip comprising a passive check valve 14 is shown in FIG. 3. Such a passive check valve may also correspond, for example, to a passive check valve as is described in DE 19719862 A1. The check valve chip comprises two silicon wafers 24 and 26 connected to each other at an interconnection area 28, for example by means of wafer bonding or gluing. The passive check valve 14 comprises a valve flap 30 structured into the silicon wafer 26, and a valve seat 32 structured into the silicon wafer 24. The valve seat 32 provides a support area, or support ridges, for the valve flap 30. Generally, the width of the support ridges and the distance between the valve flaps and the support ridges in the open state defines the flow resistance of the check valve.

The check valve shown in FIG. 3 opens when excess pressure prevails on the side of the silicon wafer 24 as compared to a pressure on the side of the silicon wafer 26. In the opposite case, a closing force acts on the check valve 14.

The check valve module or the check valve chip may be mounted on the pump diaphragm 10 in any manner suitable to provide a check valve for the through-opening 12. For example, a corresponding check valve chip may be glued into the through-opening or may be glued onto the pump diaphragm above or below the through-opening.

Embodiments of an inventive pump module have a very simple design and may be used for implementing pumps both with high achievable pressures and with low achievable pressures.

Figure 2:
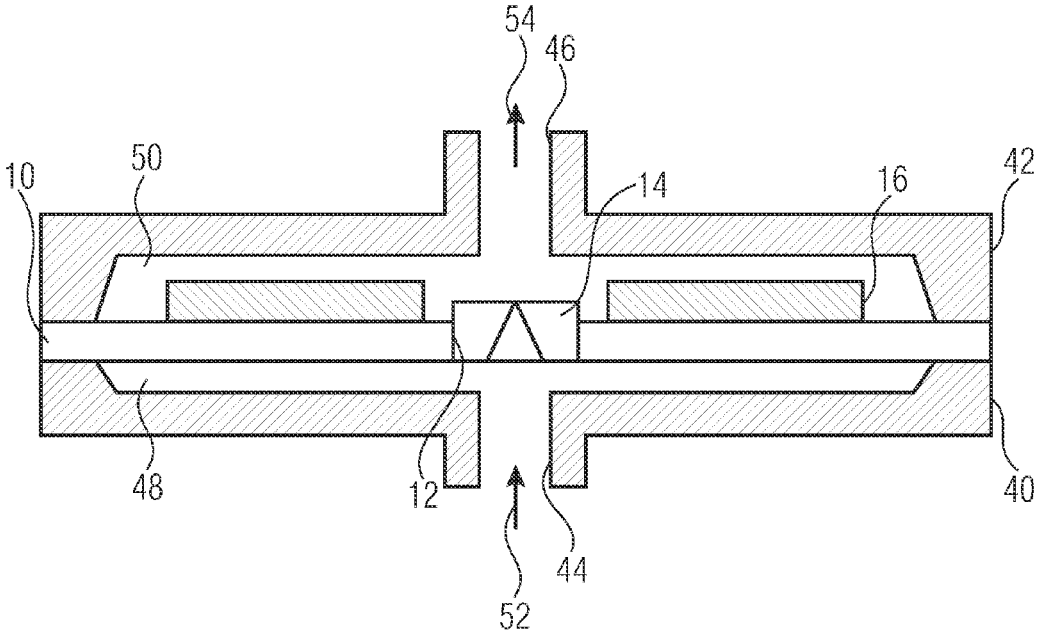
FIG. 2 shows a schematic cross-sectional view of an embodiment of an inventive pump.

A schematic cross-sectional view of an embodiment of an inventive pump is shown in FIG. 2.

In the example shown in FIG. 2, the pump module depicted in FIG. 1 is arranged within a pump chamber in that the pump diaphragm 10 is connected, at its circumference, to housing parts 40 and 42. In other words, the pump diaphragm 10 is chucked, in terms of its circumference, by the housing parts 40 and 42. The housing part 40 has an inlet opening 44 formed therein, whereas the housing part 42 has an outlet opening 46 formed therein. With the exception of the inlet opening 44 and the outlet opening 46, the pump chamber is sealed in a fluid-tight manner. The piezoceramic 16 represents an actuating means for the pump diaphragm, a control means (not shown in FIG. 2) again being provided to apply suitable actuating voltage to the piezoceramic. In this context, the pump diaphragm and the piezoceramic may represent a piezoceramic bending converter.

Upon application of an actuating voltage to the piezoceramic 16, the pump diaphragm is deflected downward, starting from the state shown in FIG. 2, due to the deformation of the piezoceramic that is caused by the actuating voltage. As a result, the volume of an inlet-side pump chamber area, defined by the pump diaphragm and the housing part 40, decreases, whereas the volume of an outlet-side pump chamber area 50, defined by the housing part 42 and the pump diaphragm 10, increases. This movement has an opening effect on the check valve, so that fluid flows from the inlet-side pump chamber area 48 to the outlet-side pump chamber area 50. Subsequently, the voltage applied to the piezoceramic 16 is switched off, so that the pump diaphragm returns to the position shown in FIG. 2. This movement of the pump diaphragm to the position shown in FIG. 2 has a closing effect on the check valve 14, so that there is no fluidic connection between the inlet-side pump chamber area 48 and the outlet-side pump chamber area 50. Therefore, with this movement of the pump diaphragm to the position shown in FIG. 2, fluid is sucked in, on the one hand, through the inlet opening 44, as is indicated by an arrow 52 in FIG. 2, and fluid is ejected, on the other hand, through the outlet opening 46, as is indicated by an arrow 54 in FIG. 2.

It shall be noted at this point that the respective movements have opening or closing effects on the check valve since the movements cause corresponding pressure ratios which have the described effects on the check valve(s).

Therefore, in a pumping cycle, the diaphragm is deflected downward starting from the position shown in FIG. 2, and is then returned to the position shown in FIG. 2. To achieve this, a square-wave voltage pulse may be applied to the piezoceramic 16, for example.

In embodiments of the invention, the flow resistance through the check valve is smaller than the flow resistance through the inlet opening. This may result in that portion of a fluid to be pumped that during a movement of the pump diaphragm from the position shown in FIG. 2 toward the inlet opening more fluid leaves the inlet-side pump chamber through the through-opening 12 provided with the check valve 14 than through the inlet opening 44.

In addition, in embodiments of the invention, the housing parts are configured such that the compression volume, i.e. the dead volume within the housing, is small. This may be achieved, for example, in that the contour of the housing parts that are opposite the pump diaphragm 10 are adapted to the contour of the pump diaphragm in the deflected state.

Figure 4:
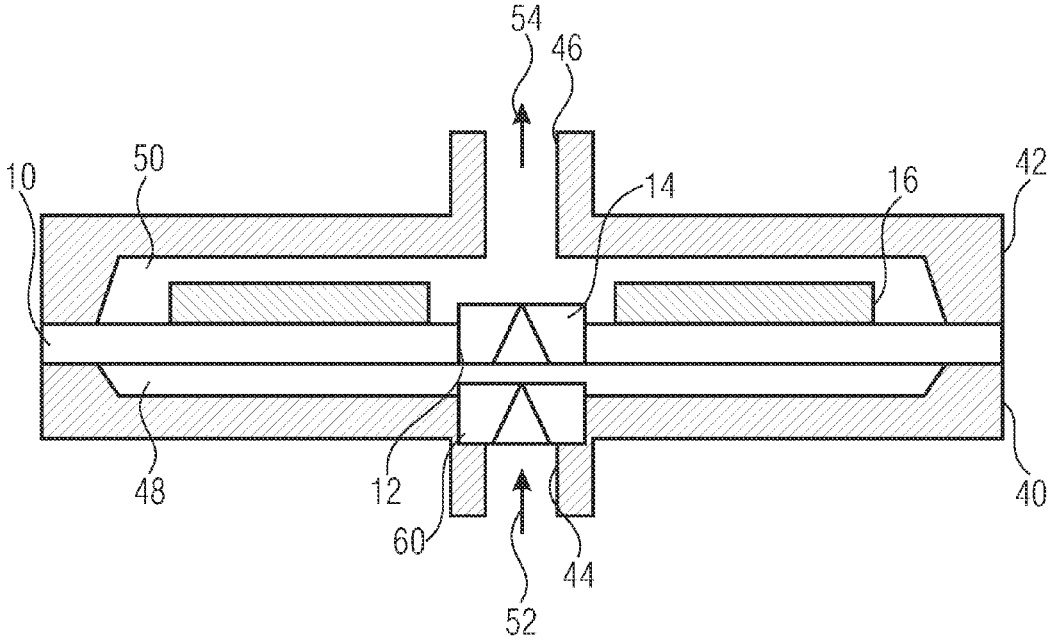
FIG. 4 shows a schematic cross-sectional view of an embodiment of an inventive pump.

A further embodiment of an inventive pump is shown in FIG. 4.

The embodiment shown in FIG. 4 comprises, in addition to the example shown in FIG. 2, a check valve 60 at the pump inlet 44. The check valve 60 is configured such that a movement of the pump diaphragm 10 from the position shown in FIG. 4 to a position deflected toward the housing part 40 has a closing effect on the check valve 60. In this manner, it can be effectively prevented that, during this movement, fluid is pressed through the inlet opening 44 in the direction opposing the actual pumping direction, since the check valve 60 prevents such a back flow. In embodiments of the invention, the check valve 60 at the inlet opening therefore enables an increase in the efficiency of the pump. The check valve 60 may be implemented in any manner, for example using a check valve chip as is shown in FIG. 3.

An alternative embodiment of an inventive pump will now be explained with reference to the schematic cross-sectional representation of FIG. 5.

Figure 5:
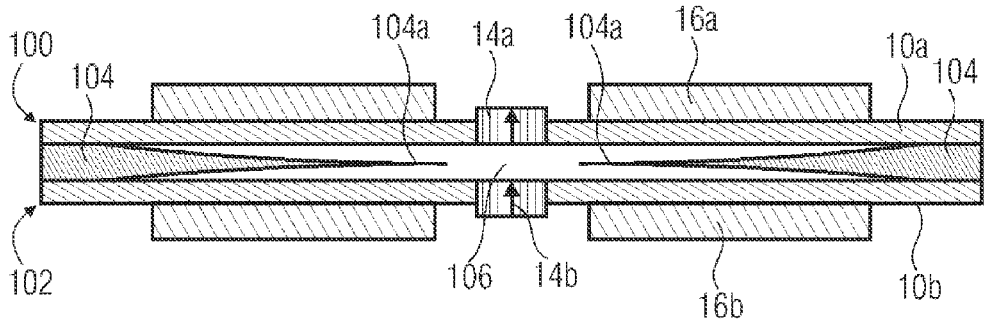
FIG. 5 shows a schematic cross-sectional view of an embodiment of an inventive pump.

The embodiment shown in FIG. 5 comprises a first pump module 100 and a second pump module 102, which are interconnected via a spacer 104. The pump modules 100 and 102 may comprise designs that correspond to the design described above with reference to FIG. 1, the respective elements of the first pump module each being characterized with the suffix "a", whereas the corresponding elements of the second pump module 102 are characterized by the suffix "b".

As may be seen from FIG. 5, the pump diaphragms 10*a* and 10*b* are arranged around the circumference of the spacer 104, so that both pump diaphragms 10*a* and 10*b* as well as the spacer 104 define a pump chamber 106. As can be seen in FIG. 5, an area 104*a* of the spacer 104 extends inward between the pump diaphragms 10*a* and 10*b*. The contour of the inwardly extending area 104*a* of the spacer 104 is adapted to the contour of the pump diaphragms 10*a* and 10*b* in the deflected state, so that the dead volume may be reduced and, ideally, may tend toward zero.

Electric connections as well as a control means or a voltage source for applying a suitable actuating voltage to the piezoceramics 16*a* and 16*b* are provided, but are not depicted in FIG. 5 for simplicity's sake.

Upon application of a corresponding actuating voltage, the pump diaphragm 10*a* is deflected downward from the position shown in FIG. 5, i.e. toward the portions 104*a* of the spacer 104, and upon application of a corresponding actuating voltage to the piezoceramic 16*b*, the pump diaphragm 10*b* is deflected upward, i.e. toward the portion 104*a* of the spacer 104. In this manner, the volume of the pump chamber 106 is reduced by applying an actuating voltage to the piezoceramics 16*a* and 16*b*. Once the voltage has been switched off, the pump diaphragms 10*a* and 10*b* return to the position shown in FIG. 5, whereby the volume of the pump chamber is increased again. The movement of the pump diaphragms 10*a* and 10*b* for increasing the volume of the pump chamber may be referred to as a suction stroke, whereas the movement of the pump diaphragms for reducing the pump chamber volume may be referred to as a delivery stroke. The check valve 14*a* is configured such that a movement during the delivery stroke has an opening effect, whereas a movement during the suction stroke has a closing effect. By contrast, the check valve 14*b* is configured such that a movement during the delivery stroke has a closing effect, and a movement during the suction stroke has an opening effect. In this manner, fluid is sucked in, during the suction stroke, through the check valve 14*b*, which is open at this point, whereas fluid is ejected, during the delivery stroke, through the check valve 14*a*, which is open at this point. Thus, a net pumping action from the inlet opening formed by the through-opening within the pump diaphragm 10*b* to the outlet opening formed by the through-opening within the pump diaphragm 10*a* is achieved.

In the embodiment of an inventive micro pump shown in FIG. 5, therefore, two piezoelectric pump diaphragms are arranged opposite one another and may oscillate in phase opposition. In embodiments of the invention, the pump diaphragms may consist of stainless spring steel. In embodiments, the pump diaphragms may each comprise, at their centers, one opening which may have a check valve integrated therein. As has already been set forth, in embodiments, the pump diaphragms may have a circular circumference, it being possible for a piezoelectric ceramic to be glued on in an annular manner around the through-openings.

In embodiments of the present invention, the pump diaphragm(s) may therefore have check valves integrated therein, for example passive check valves that are made of silicon by means of micro system engineering. In the example shown in FIG. 5, the inlet and the outlet of the check valves are located on the top surfaces or the bottom surfaces of the pump diaphragms, respectively, so that a media transport takes place through the pump diaphragm from the bottom surface to the top surface of the diaphragm.

In embodiments of the invention, the passive check valve(s) integrated into the diaphragm is, or are, arranged where the largest deflection of the pump diaphragm and, thus, the largest volume displacement takes place. In embodiments, this is, for example, the center of a circular pump diaphragm, which may also be referred to as an actuator diaphragm. This may achieve that the fluid volume flowing through the pump gets to travel the shortest distance from the inlet to the outlet of the pump. As was already set forth, in embodiments of the invention, a spacer, arranged between two pump diaphragms, for realizing as large a compression ratio as possible, is configured such that the pump chamber volume is as large, if possible, as the displacement volume of the pump diaphragms.

During operation of an embodiment comprising two pump diaphragms, the piezoceramics associated with both pump diaphragms may be provided with the same electrical periodic control signal, which results in that both pump diaphragms oscillate in phase, and, in this manner, reduce and increase the pump chamber volume simultaneously, respectively. As a result, a medium to be pumped, for example a liquid or a gas, may be delivered from the inlet side of the inlet-side pump diaphragm to the outlet side of the outlet-side pump diaphragm via the pump chamber. The pump direction is defined by the directions in which the check valves within the diaphragms enable a flow.

Figure 6:
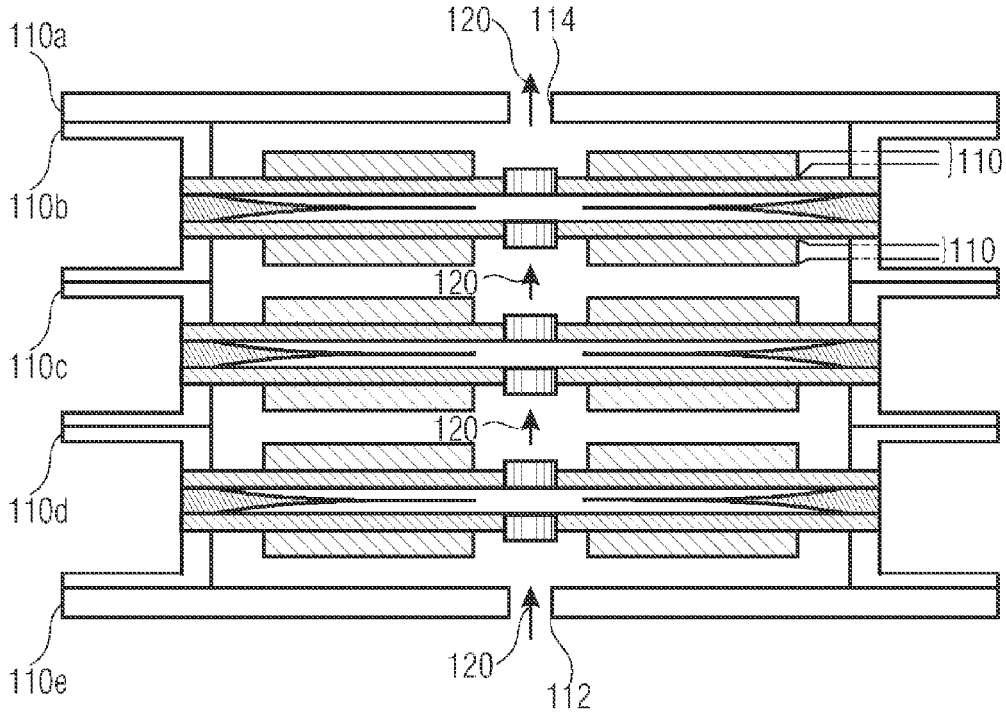
FIG. 6 shows a schematic cross-sectional view of a series connection of three pumps in accordance with FIG. 5.

FIG. 6 shows an embodiment of an inventive pump arrangement, wherein three pumps as are depicted in FIG. 6 are stacked in order to be fluidically connected in series.

As may be seen in FIG. 6, three pumps, which may correspond to the pumps described with reference to FIG. 5, respectively, are fluidically connected in series by housing parts 110*a*, 110*b*, 110*c*, 110*d* and 110*e* so that a pumping path exists between a pump arrangement inlet 112 and a pump arrangement outlet 114, as is indicated by arrows 120 in FIG. 6.

The micro pump arrangement shown in FIG. 6 may be considered as a compressor having several pumps stacked one on top of the other. The pumps may be connected to one another in various ways, for example by means of clamping, gluing or other suitable interconnection techniques. Such an arrangement automatically ensures pressure compensation of the pump diaphragms. Electrical contacting of the piezoelectric ceramics may also be effected via the connection sites, or via corresponding housing parts, as is schematically depicted by reference numeral 110 in FIG. 6 for the topmost pump module. In the example shown in FIG. 6, a suitable termination is mounted, by means of housing parts 110*a* and 110*e*, on the top and bottom surfaces of the resulting pump stack. Said suitable termination may be provided with corresponding terminals for the medium to be pumped, for example Luer connections or the like.

The opening direction of all of the check valves in the example shown in FIG. 6 is from bottom to top, so that upon simultaneous actuation of the diaphragms, as was explained above with reference to FIG. 5, a pumping action from the pump arrangement inlet 112 to the pump arrangement outlet 114 is achieved. By means of such a stacked arrangement, higher final pressures may be achieved.

Embodiments of the present invention are based on a drive by a piezoelectric ceramic. In alternative embodiments, alternative drives, for example electrostatic drives, may be used. With an electrostatic drive, areas of the pump diaphragm may serve as electrodes, whereas counterelectrodes are provided to attract said membrane areas in order to be able to effect corresponding deflection of the diaphragm.

By means of the way in which fluid is guided through the pump diaphragm(s), embodiments of the present invention enable the fluid flow to suffer minimum losses caused by being rerouted, and enable that the actuator diaphragms are automatically in a pressure-compensated state.

In embodiments of the invention, a control means may be provided for operating the pump diaphragm(s) (for example a piezo steel ring actuator) at its resonant frequency, whereby the oscillation amplitude of same may be maximized while the operating voltage is low only, which in turn may enable very large delivery volumes.

In embodiments of inventive pumps, pump arrangements and pump modules, the movable parts, i.e. the one or more pump diaphragms, may be configured such that the first mechanical resonance is above the audible one. The audible threshold may be considered to be a frequency of 20 kHz, as of which a normal adult can no longer perceive any sounds. For example, the pump diaphragms may be configured such that the first mechanical resonance of same is between 20 and 40 kHz. The control means may be provided to operate the pump diaphragm(s) at the first mechanical resonance of same, so that any noise pollution may be avoided due to the low sound emission.

Inventive micro pumps or micro compressors may achieve delivery rates that so far have not been known for piezo-driven actuators. For example, delivery rates, in the resonance operation, of between 1.6 and more than 2 liters per minute may be achieved using inventive pumps, for example at a control voltage (peak to peak) of 100 volts or below, a diameter of about 50 mm or below for the micro compressor, and a thickness of 300 μm for the actuator diaphragm, and of 500 μm for the piezo diaphragm, and a thickness of 1.8 mm or below for the entire pump module in accordance with FIG. 5 (without the housing). Such delivery rates are higher, by a factor of 50, than the delivery rates (with air as the medium to be delivered) of known piezo-driven micro pumps.

Embodiments of inventive pumps may be used for any technical fields of application, for example micro cooling systems, fuel cells, or portable devices requiring an air or gas flow within the range of one liter/minute and more.

Embodiments of the present invention enable high delivery rates at desired pressures while using a piezo-diaphragm ring actuator having an inlet and an outlet, said piezo-diaphragm ring actuator comprising a recess which has a micro valve mounted therein.

In embodiments of the invention, a check valve is provided within the diaphragm. In alternative embodiments of the invention, several check valves having identical actions may be arranged, side by side, within the pump diaphragm in parallel.

The housing parts described above with reference to embodiments of the invention may consist of any suitable materials, for example plastic, glass, silicon, metal or the like.

In embodiments of the present invention, the pump diaphragm and/or the piezoceramic arranged thereon may be provided with an insulating layer so as to enable pumping even liquid media without running the risk of a short-circuit.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A pump, comprising:

an inlet opening;

an outlet opening;

a pump diaphragm comprising an opening, provided with a passive check valve, through the pump diaphragm;

an actuator configured to move the pump diaphragm between a first position and a second position, wherein the passive check valve is configured such that a movement from the first position in the direction toward the second position closes the passive check valve, and that a movement from the second position in the direction toward the first position opens the passive check valve, so that a pumping cycle wherein the pump diaphragm is moved from the first position to the second position, and back, causes a net flow from the inlet opening to the outlet opening;

a further pump diaphragm comprising an opening, provided with a further passive check valve, through the further pump diaphragm;

a further actuator configured to move the further pump diaphragm between a third position and a fourth position; and a spacer arranged between the pump diaphragm and the further pump diaphragm which, along with the pump diaphragms, defines a pump chamber, wherein the outlet opening is formed by the opening within the pump diaphragm and is provided with the passive check valve, and wherein the inlet opening is formed by the opening within the further pump diaphragm and is provided with the further passive check valve, wherein the actuator and the further actuator are configured to move the pump diaphragm and the further pump diaphragm such that the volume of the pump chamber is increased during a suction phase, and that the volume of the pump chamber is reduced during a pumping phase, wherein the passive check valve is configured such that a movement of the pump diaphragms during the suction phase closes the passive check valve, and that a movement of the pump diaphragms during the pumping phase opens the passive check valve, wherein the further passive check valve is configured such that a movement of the pump diaphragms during the suction phase opens the further passive check valve, and that a movement of the pump diaphragms during the pumping phase closes the further passive check valve, wherein the actuator and the further actuator are configured to move the pump diaphragm and the further pump diaphragm in opposite directions during the suction phase, and to move the pump diaphragm and the further pump diaphragm in opposite directions during the pumping phase, wherein first main surfaces of the pump diaphragm and first main surfaces of the further pump diaphragm are arranged opposite to one other, wherein the actuator and the further actuator are respectively arranged on second main surfaces of the pump diaphragm and second main surfaces of the further pump diaphragm that are respectively opposite to the first main surfaces of the pump diaphragm and the first main surfaces of the further pump diaphragm, wherein the spacer includes a first surface facing the pump diaphragm and spaced therefrom in a non-deflected state of the pump diaphragm and a second surface facing the further pump diaphragm and spaced therefrom in a non-deflected state of the further pump diaphragm, and wherein contours of the first and second surfaces are adapted to contours of the pump diaphragm and the further pump diaphragm in a deflected state and extend between the first main surfaces of the pump diaphragm and the first main surfaces of further pump diaphragm to overlap with the actuator and the further actuator in a plan view.

2. The pump as claimed in claim 1, wherein the inlet opening and the outlet opening are arranged to be opposite each other in the pump diaphragm and the further pump diaphragm.

3. The pump as claimed in claim 1, further comprising a controller so as to make the pump diaphragm and the further pump diaphragm oscillate in phase with each other, so that during the suction phase both pump diaphragms increase the volume of the pump chamber, and so that during the pumping phase both pump diaphragms reduce the volume of the pump chamber.

4. The pump as claimed in claim 1, wherein the pump diaphragms are essentially circular, and the openings through same, which are provided with the passive check valves, are centrally arranged within the pump diaphragms.

5. The pump as claimed in claim 1, wherein the actuator in each case is a piezoceramic arranged on the pump diaphragm.

6. The pump as claimed in claim 1, wherein the pump diaphragms are comprised of metal.

7. The pump as claimed in claim 1, wherein the passive check valve in each case is a silicon valve within a silicon chip mounted on the pump diaphragm.

8. The pump as claimed in claim 1, further comprising an insulating coating arranged, in each case, on the actuator and on the pump diaphragm.

9. The pump as claimed in claim 1, wherein the pump diaphragm and the further pump diaphragm are configured such that their first mechanical resonance is above 20 kHz.

10. The pump as claimed in claim 1, wherein the actuator is configured to operate the pump diaphragms at its first mechanical resonance.

11. The pump as claimed in claim 1, wherein:

each of the passive check valves and each of the further passive check valves includes a valve flap and a valve seat;

each of the passive check valves is mounted to the pump diaphragm to move the pump diaphragm; and each of the further passive check valves is mounted to the further pump diaphragm to move the further pump diaphragm.

* * * * *